US005706788A

United States Patent [19]

Hosoi

[11] Patent Number: 5,706,788

[45] Date of Patent: Jan. 13, 1998

[54] ACCELERATION TIME CONTROLLER FOR INTERNAL COMBUSTION ENGINE

[75] Inventor: Keiji Hosoi, Shizuoka-ken, Japan

[73] Assignee: Suzuki Motor Corporation, Shizuoka-ken, Japan

[21] Appl. No.: 717,262

[22] Filed: Sep. 20, 1996

[30] Foreign Application Priority Data

Dec. 29, 1995 [JP] Japan ..... 7-354251

[51] Int. Cl.[6] ..... F02D 41/10

[52] U.S. Cl. ..... 123/492

[58] Field of Search ..... 123/492

[56] References Cited

U.S. PATENT DOCUMENTS 4,711,200 12/1987 Kinoshita ..... 123/492

FOREIGN PATENT DOCUMENTS 63-106339 5/1988 Japan .

*Primary Examiner*—Andrew M. Dolinar

*Attorney, Agent, or Firm*—Flynn, Thiel, Boutell and Tanis, P.C.

[57] ABSTRACT

An arrangement to carry out an enrich delay control operation without fail, start an enrich control operation after an elapse of a predetermined time with certainty, and improve control reliability. For this purpose, control means is provided with functions to (1) store a previous throttle full opening time upon reception of a throttle opening signal from a throttle sensor for detecting a throttle opening of a throttle valve, (2) obtain a new throttle full opening time by integrating a current throttle full opening time under predetermined conditions for identifying continuous full-open acceleration, with a previous throttle full opening time, (3) store the new throttle full opening time as the previous throttle full opening time when the new throttle full opening time is less than the predetermined time, and (4) start the enrich delay control operation of the internal combustion engine when the new throttle opening time is greater than or equal to the predetermined time.

4 Claims, 5 Drawing Sheets

ACCELERATION TIME CONTROLLER FOR INTERNAL COMBUSTION ENGINE

FIELD OF THE INVENTION

The invention relates to an acceleration time controller for an internal combustion engine and, more particularly, to an acceleration time controller for an internal combustion engine which carries out enrich delay control without fail, starts enrich control after an elapse of a predetermined time with certainty and improves control reliability.

BACKGROUND OF THE INVENTION

An internal combustion engine mounted on a vehicle shows a tendency to employ an exhaust gas mode including abrupt departure and high speed (for example, 80 mph) and control the discharge amounts of CO and HC at the beginning of full-open acceleration. A small displacement vehicle requires enrich control at the time of full-open acceleration, that is, an increase in power. In order to start enrich control, enrich delay control is carried out to inhibit enrich control for the first several seconds in a full open state of a throttle.

An example of an acceleration time controller for an internal combustion engine is disclosed in unexamined published Japanese patent application JP-A 106339/1988. A fuel controller for an engine equipped with an exhaust turbo-supercharger disclosed in this publication comprises means for detecting an up-shift in the previous acceleration state, compensation means for increasing the amount of fuel supplied for a predetermined time after the detection of an up-shift by the detection means, and means for carrying out fuel supply control based on the amount of fuel increased by the fuel increase compensation means so as to prevent the occurrence of abnormal combustion such as knocking caused by an abnormal rise in supercharging pressure generated when an up-shift is performed in a full open state of a throttle.

In a prior art acceleration time controller for an internal combustion engine, enrich control, that is, an increase in power, is carried out when enrich control conditions are established. That is, as shown in FIG. 5, when a vehicle shifts from a steady state to an acceleration state, for instance, the opening of the throttle exceeds a predetermined value, power is increased and the air/fuel ratio (A/F) is decreased from about 14.5 to about 12.0 based on that of the steady state.

Enrich delay control is carried out so as to reduce the discharge of an exhaust gas. As shown in FIG. 6, when a vehicle shifts from a steady state to an acceleration state, for example, the opening of the throttle exceeds a predetermined value, the time of carrying out enrich control is delayed for a predetermined time period (minimum of 2 seconds) from the time when enrich control conditions are established, and the air/fuel ratio (A/F) is set from about 14.5 to about 12.0 based on that of the steady state after an elapse of the predetermined time.

Generally speaking, a low-output vehicle has to carry out full-open acceleration when power is increased and is forced to carry out full-open departure and full-open acceleration at each time of acceleration. To eliminate damage to the internal combustion engine or catalyst at the time of driving in a full open state of the throttle (WOT) in an automatic transmission low-output vehicle, when enrich delay control in which the predetermined time is set to 8 seconds is carried out, as shown in FIG. 7, it is determined whether or not enrich control conditions are established.

As for determining whether or not enrich control conditions are established, when a power switch PSW is turned on as the opening of the throttle is 60° or more (full-open acceleration state in a low-output vehicle) and the sum of an intake manifold pressure PMM and a value obtained by subtracting an atmospheric pressure PMA from 750 is equal to or more than a constant KPMPOW (50 mmHg in the case of swift), it is determined that enrich control conditions are established and a power increase FPOW is effected.

When the enrich control conditions are established, enrich delay control is started. However, as shown in FIG. 8, the opening of the throttle is returned from its full open state at the time of an up-shift and the vehicle gets out of enrich delay control. When the throttle is fully opened after the up-shift, the vehicle newly enters enrich delay control. That is, entry into and removal from enrich delay control are performed each time an up-shift is carried out, and by this entry into and removal from enrich delay control, a delay time, that is, a predetermined time, is reset.

As a result, there is such inconvenience that power is not increased and control reliability is deteriorated by resetting the predetermined time each time an up-shift is carried out, which is practically disadvantageous.

SUMMARY OF THE INVENTION

To eliminate the above inconvenience, the present invention comprises an acceleration time controller for an internal combustion engine having control means for carrying out an enrich delay control operation which starts an enrich control operation for a power increase after an elapse of a predetermined time from a time when enrich control conditions are established at a time of acceleration of the internal combustion engine, a throttle valve is provided along an intake passage of the internal combustion engine, a throttle sensor for detecting the throttle opening of the throttle valve is provided, and the control means is provided with means for storing the previous throttle full opening time upon reception of a throttle opening signal from the throttle sensor, means for obtaining a new throttle full opening time by integrating the current throttle full opening time under predetermined conditions for identifying continuous full-open acceleration with the previous throttle full opening time, means for storing the new throttle full opening time as the previous throttle full opening time when the new throttle full opening time is less than the above predetermined time, and means for starting the enrich delay control operation of the internal combustion engine when the new throttle full opening time is greater than or equal to the predetermined time.

Owing to the above constitution, the control means (1) stores the previous throttle full opening time upon reception of the throttle opening signal from the throttle sensor, (2) obtains a new throttle full opening time by integrating the current throttle full opening time under the predetermined conditions for identifying continuous full-open acceleration, with the previous throttle full opening time, (3) stores the new throttle full opening time as the previous throttle full opening time when the new throttle full opening time is less than the predetermined time, and (4) starts the enrich delay control of the internal combustion engine when the new throttle full opening time is greater than or equal to the predetermined time, whereby enrich delay control is carried out without fail and enrich control is started after an elapse of the predetermined time with certainty.

The preferred embodiments of the present invention will be described in detail with reference to the accompanying drawings.

BRIEF DESCRIPTION OF THE DRAWINGS

FIG. 4 is a diagram showing the measurement of a time TPOWON during which the FPOW (power increase) determining conditions are kept ON;

DETAILED DESCRIPTION

Figure 1:
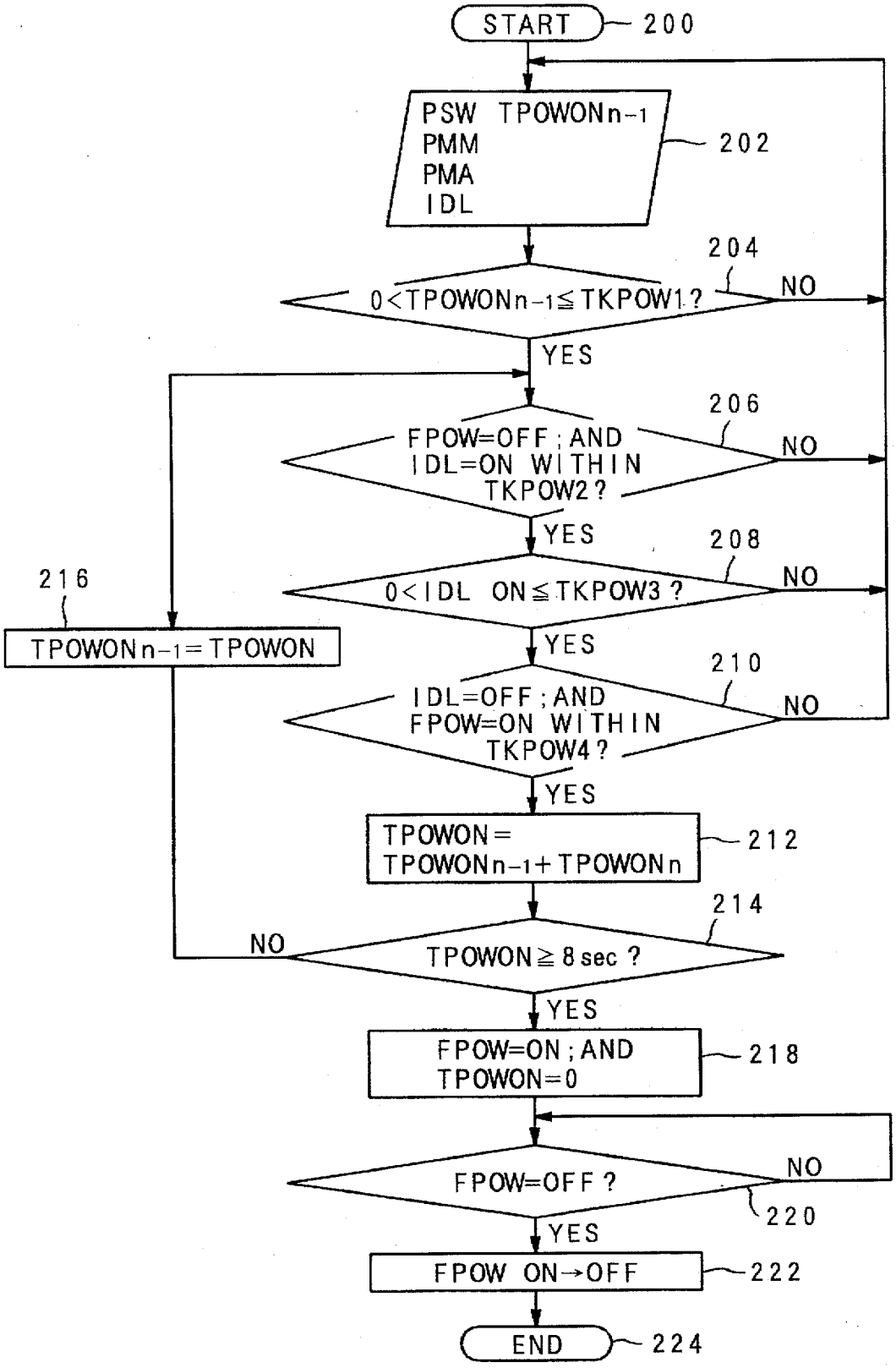
FIG. 1 is a control flow chart of an acceleration time controller for an internal combustion engine according to an embodiment of the present invention.
Figure 2:
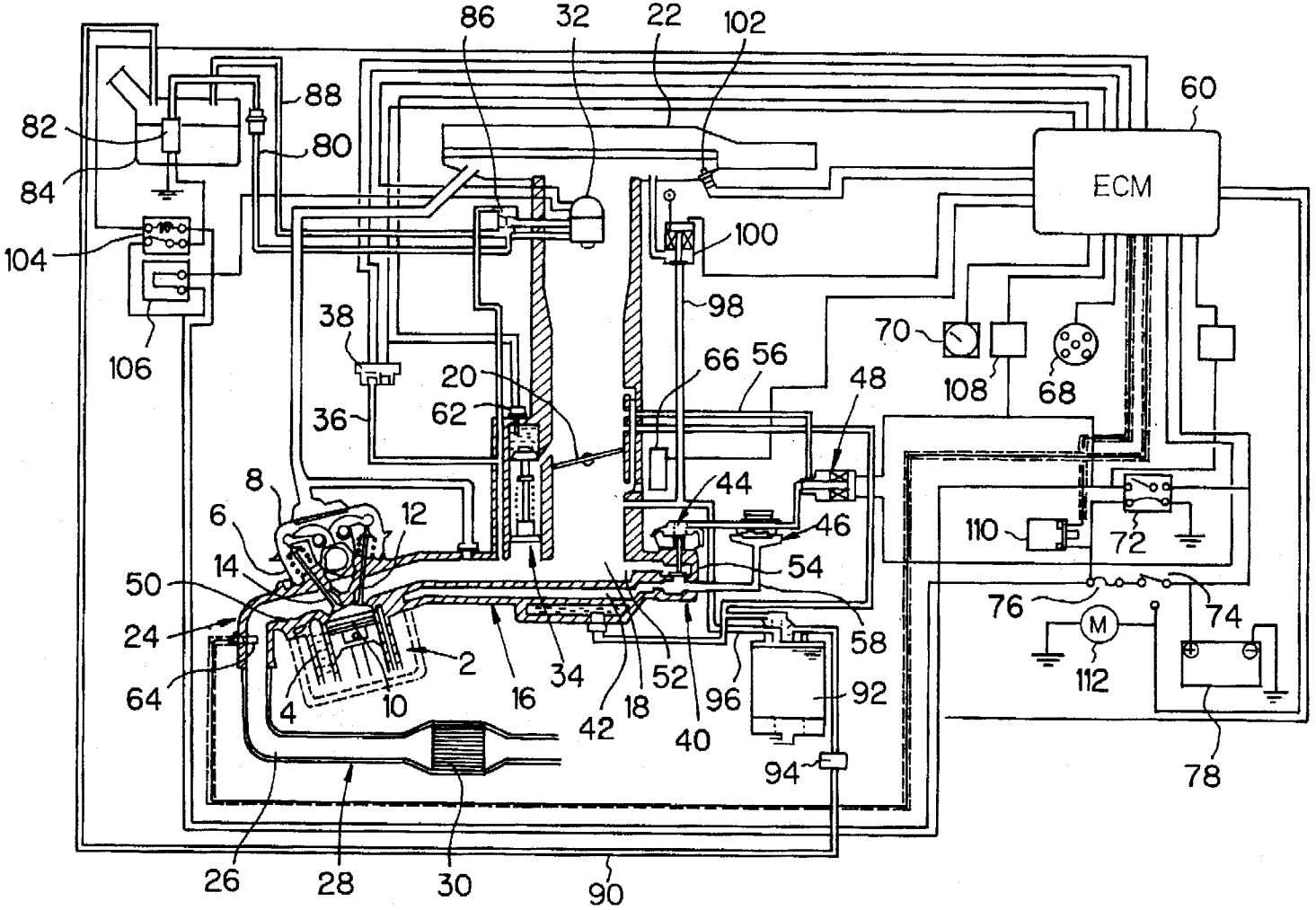
FIG. 2 is a schematic structural view of the acceleration time controller for an internal combustion engine.

FIGS. 1 to 4 show an embodiment of the present invention. In FIG. 2, reference numeral 2 is an internal combustion engine, 4 a cylinder block, 6 a cylinder head, 8 a cylinder head cover, 10 a combustion chamber, 12 an intake valve, 14 an exhaust valve, 16 an intake manifold, 18 an intake passage, 20 a throttle valve, 22 an air cleaner, 24 an exhaust manifold, 26 an exhaust passage, 28 an exhaust pipe and 30 a catalyst.

A single fuel injection valve 32 is provided in the intake passage 20 on a downstream side of the air cleaner 22. The intake manifold 16 is provided with a fast idle mechanism 34 for supplying air to the combustion chamber 10 bypassing the throttle valve 20. One end of a pressure detection passage 36 communicates with the intake passage 18 on a downstream side of the throttle valve 20. At the other end of the pressure detection passage 36, a pressure sensor 38 for detecting the pressure of an intake pipe is provided.

An exhaust gas recycling unit (EGR unit) 40 for recycling part of an exhaust gas to the intake-system of the internal combustion engine 2 is provided in the internal combustion engine 2. The exhaust gas recycling unit 40 recycles part of an exhaust gas into the combustion chamber 10 of the internal combustion engine 2 to lower the combustion temperature and reduce the amount of Nox generated. To ensure the operation of the internal combustion engine 2, the EGR unit 40 becomes inoperative when the internal combustion engine 2 is cold, the throttle valve 20 is fully opened, the internal combustion engine 2 performs high-load operation, and the pressure of an intake pipe is low.

The exhaust gas recycling unit 40 has an EGR passage 42, an EGR control valve 44, an EGR modulator 46 and an EGR solenoid valve 48. One end of the EGR passage 42 communicates with an EGR intake port 50 which is open to the exhaust passage 26 and the other end thereof is open to the EGR recycle port 52 which is open to the intake passage 18 on a downstream side of the throttle valve 20. The EGR control valve 44 is provided on the intake manifold 16 to adjust the amount of the recycled exhaust gas by opening and closing the EGR passage 42 by means of a valve body 54.

The EGR control valve 44 opens and closes the EGR passage 42 by the operation of the valve body 54 fixed to an unshown valve diaphragm which is displaced by pressure (negative pressure) applied to an unshown pressure chamber from a pressure passage 56. One end of the pressure passage 56 communicates with an unshown pressure intake port which is open in the vicinity of the throttle valve 20 and the other end thereof communicates with the pressure chamber.

In the pressure passage 56, there are provided the EGR modulator 46 and the EGR solenoid valve 48 sequentially from the side of the EGR control valve 44. The EGR modulator 46 adjusts the pressure (negative pressure) of the pressure passage 56 by introducing air by the operation of an unshown valve body for a modulator which is caused by the displacement of an unshown diaphragm for a modulator by exhaust pressure applied to an unshown exhaust pressure chamber from an exhaust introduction passage 58. The EGR solenoid valve 48 is electrically activated to open and close the pressure passage 56.

The EGR solenoid valve 48 is coupled to the control means 60, for example an electronic control module. The control means 60 is also connected to the aforementioned pressure sensor 38, a temperature sensor 62, provided in the fast idle unit 34, for detecting the temperature of cooling water, an exhaust sensor 64 provided in the exhaust manifold 24, a throttle sensor 66 for detecting the opening of the throttle valve 20, a crank angle sensor 68 which also functions as a speed sensor for detecting an engine speed, and a speed meter 70.

The EGR solenoid valve 48 is connected to a main relay 72. The main relay 72 is connected to an ignition switch 74, a fuse 76 and a battery 78. The fuel injection valve 32 communicates with one end of a fuel supply passage 80. To the other end of the fuel supply passage 80 is connected a fuel pump 82. The fuel pump 82 is installed in a fuel tank 84. An unshown fuel filter is provided along the fuel supply passage 80.

A fuel pressure regulator 86 is provided along the fuel supply passage 80. To the fuel pressure regulator 86 is connected one end of a fuel return passage 88. The other end of the fuel return passage 88 is provided open in the fuel tank 84.

One end of a fuel return pressure passage (unshown) communicates with the unshown regulator pressure chamber of the aforementioned fuel pressure regulator 86. The other end of the fuel return pressure passage communicates with the aforementioned intake passage 18.

One end of a purge passage 90 communicates with the fuel tank 84. The other end of the purge passage 90 is provided with a canister 92. The purge passage 90 is provided with a two-way valve 94. One end of an evaporation passage 96 is coupled to the canister 92. The other end of the evaporation passage 96 communicates with the intake passage 18.

To the aforementioned air cleaner 22 is connected to one end of an idle air passage 98. The other end of the idle air passage 98 communicates with the intake passage 18 on a downstream side of the throttle valve 20. An ISC valve (VSV) 100 is provided along the idle air passage 98.

Reference numeral 102 is an intake temperature sensor attached to the aforementioned air cleaner 22, 104 a relay coupled to the aforementioned fuel pump 82, 106 a register coupled to the relay 104, 108 an engine check lamp, 110 an ignition coil and 112 a starter motor.

The control means 60 receives various signals such as an exhaust sensor signal from an exhaust sensor 64, a throttle opening signal from the throttle sensor 66, a vehicle speed signal from the speed meter 70, an engine speed signal from the crank angle sensor 68, an intake pipe negative pressure signal from the pressure sensor 38, a cooling water temperature signal, and an intake temperature signal from the intake temperature sensor 102, and carries out enrich delay control for starting enrich control for a power increase after an elapse of a predetermined time.

Figure 3:
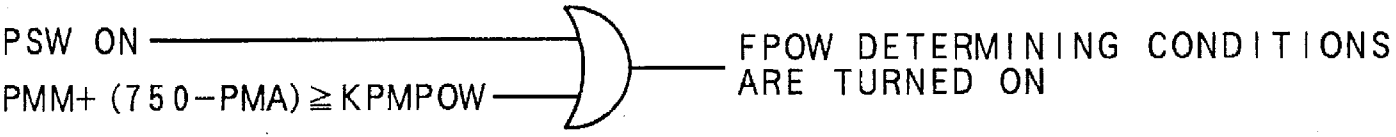
FIG. 3 is a diagram showing FPOW (power increase) determining conditions.

It is determined that the enrich (power increase) control conditions, as shown in FIG. 3, are established when a power switch PSW is turned on and the sum of an intake manifold pressure PMM as a pressure of an intake pipe and a value obtained by subtracting an atmospheric pressure PMA from 750 is equal to or more than a constant KPMPOW. When the above conditions are met, a power increase FPOW is carried out. The above predetermined time is set to 8 seconds, for example.

The aforementioned control means 60 has functions to receive a throttle opening signal from the throttle sensor 66, store the previous throttle full opening time, obtain a new throttle full opening time by integrating the current throttle full opening time under predetermined conditions for identifying continuous full-open acceleration with the previous throttle full opening time, store this new throttle full opening time as the previous throttle full opening time when the new throttle full opening time is less than the aforementioned predetermined time, and start enrich delay control of the aforementioned internal combustion engine 2 when the new throttle full opening time is equal to or more than the predetermined time.

Stated in more detail, the above-described predetermined conditions are established when the following four items are satisfied, for example, at the time of full-open acceleration before and after an up-shift and this state is identified as continuous full-open acceleration.

Figure 4:
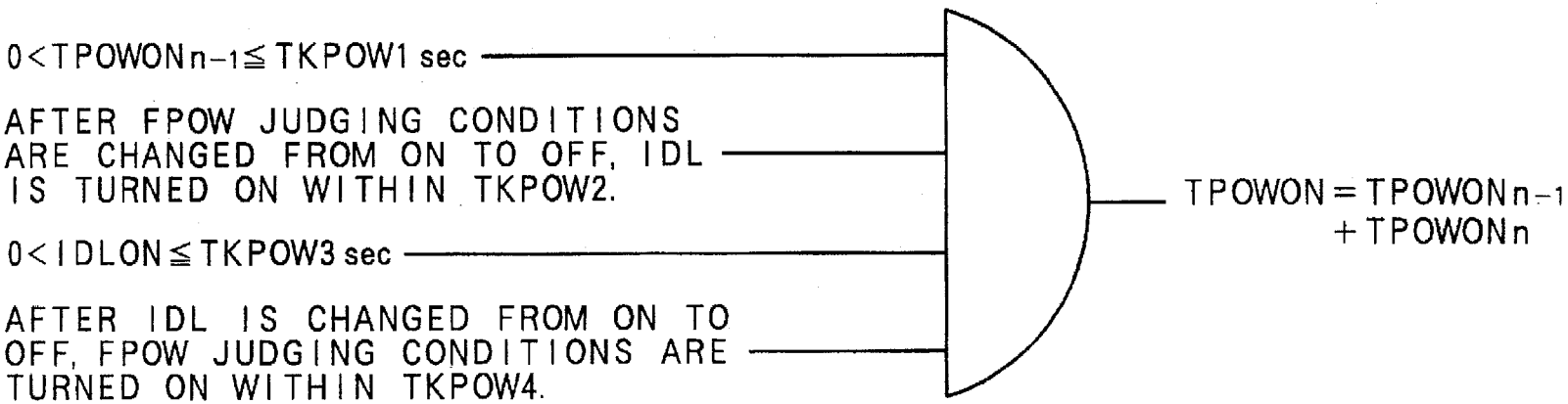
Figure 5:
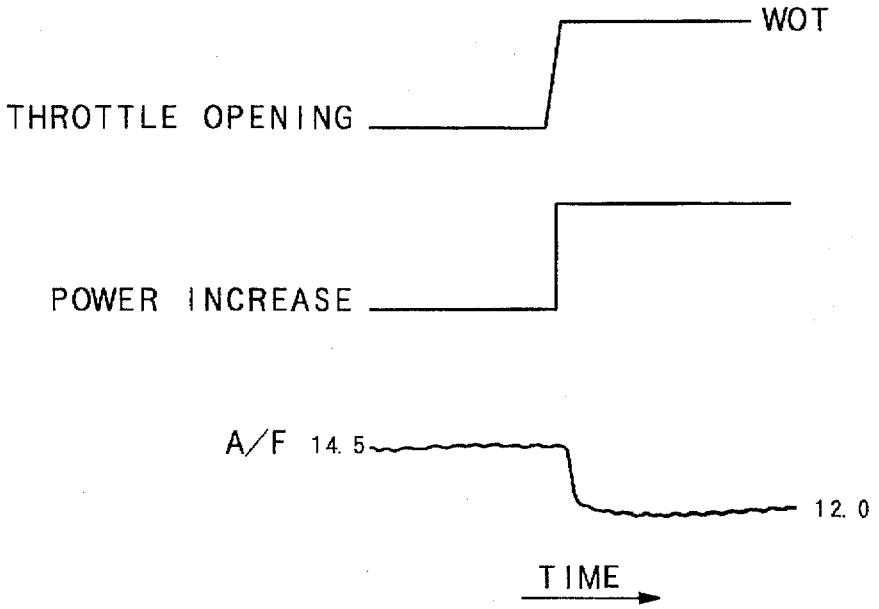
FIG. 5 PRIOR ART
FIG. 5 is a time chart of enrich control of the prior art.
Figure 6:
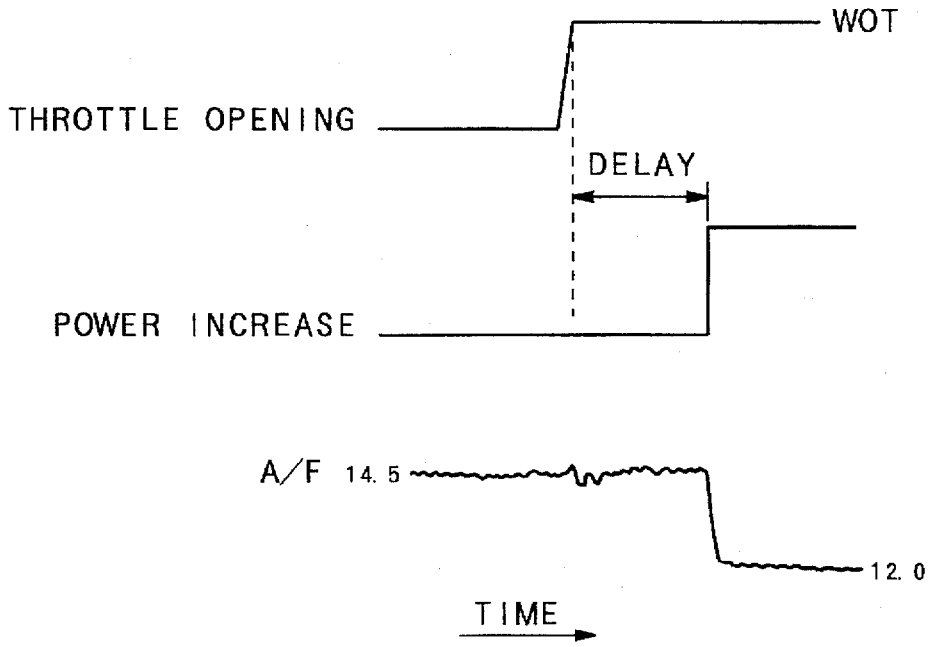
FIG. 6 is a time chart of enrich delay control.
Figure 7:
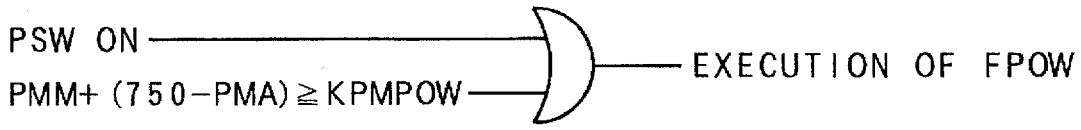
FIG. 7 is a diagram showing the FPOW (power increase) determining conditions.
Figure 8:
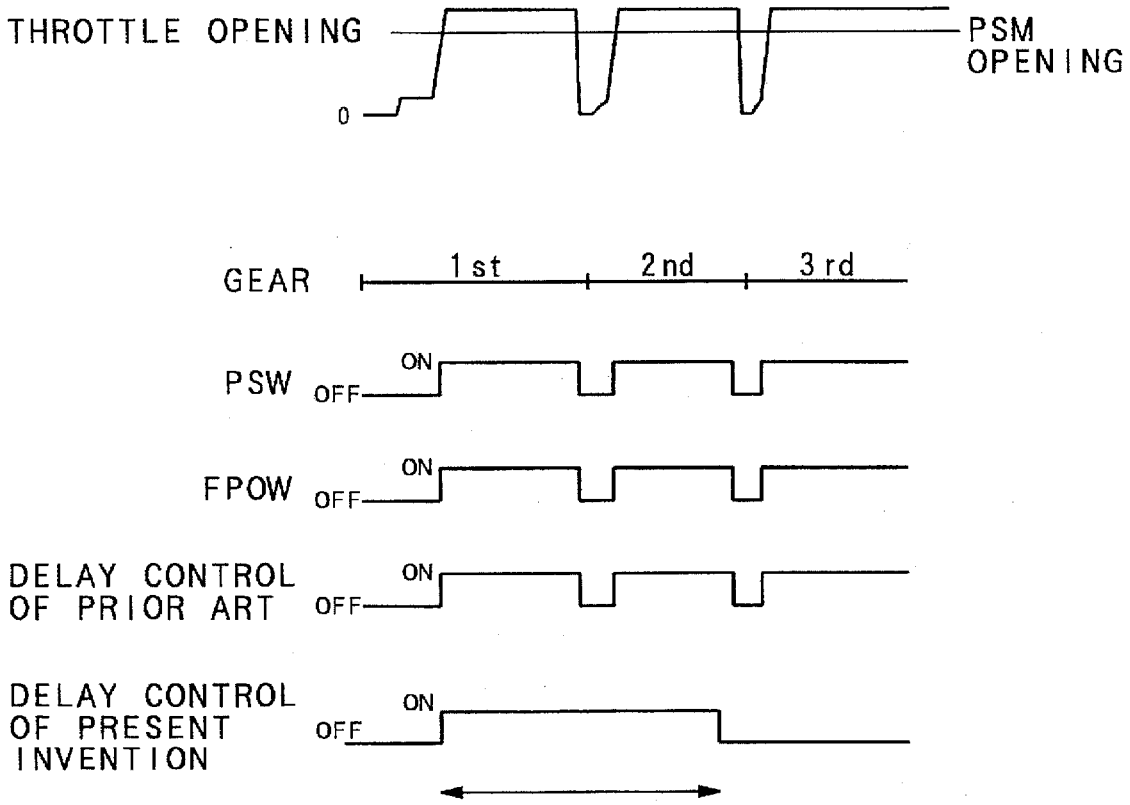
FIG. 8 is a time chart showing inconvenience at the time of enrich delay control.

The four items of the above predetermined conditions are described below as shown in FIG. 4. (1) A time TPOWONn-1 during which the previous throttle full opening time, that is, FPOW (power increase) determining conditions as enrich (power increase) control conditions are kept ON, is greater than 0 and is less than or equal to a first time constant TKPOW1. (2) An idle IDL is turned ON within a second time constant TKPOW2 after the FPOW (power increase) determining conditions are changed from ON to OFF. (3) A time during which the idle IDL is kept ON (IDLON) is greater than 0 and less than or equal to a third time constant TKPOW3. (4) The FPOW (power increase) determining conditions are turned ON within a fourth time constant TKPOW4 after the idle IDL is changed from ON to OFF.

When these predetermined conditions are established, a time TPOWON during which the FPOW (power increase) determining conditions are kept ON, i.e., a new throttle full opening time, is obtained by integrating a time TPOWONn during which the FPOW (power increase) determining conditions are kept ON, i.e., the current throttle full opening time, with a time TPOWONn-1 during which the previous FPOW (power increase) determining conditions are kept ON, i.e., the previous throttle full opening time. The time TPOWON during which the FPOW determining conditions (power increase) are kept ON is stored as the time TPOWONn-1 during which the previous FPOW (power increase) determining conditions are kept ON, when the time TPOWON during which the new FPOW (power increase) determining conditions are kept ON is less than the above predetermined time.

When the time TPOWON during which the FPOW (power increase) determining conditions are kept ON is equal to or more than the predetermined time, control is performed to start the enrich delay control of the aforementioned internal combustion engine 2. A description is subsequently given of operation with reference to the control flow chart of the internal combustion engine 2 of FIG. 1.

When a control program is started (200), a signal from the power switch PSW, an intake manifold pressure PMM, an atmospheric pressure PMA, and a signal from the idle IDL are applied to the control means 60, and, as shown in FIG. 3, the control means 60 receives a throttle opening signal from the throttle sensor 66 and stores the previous throttle full opening time after enrich (power increase) control conditions are established (202).

Thereafter, the control means 60 determines whether or not the time TPOWONn-1 during which the previous FPOW (power increase) determining conditions are kept ON, is greater than 0 and less than or equal to the first constant (8 seconds) TKPOW1 (204). When the result of this step (204) is NO, after enrich (power increase) control conditions are established, the control means 60 receives a throttle opening signal from the throttle sensor 66 to return to the process of storing the previous throttle full opening time (202). When the result of step (204) is YES, after the FPOW (power increase) determining conditions are changed from ON to OFF, the control means 60 determines whether or not the idle IDL is turned ON within the second constant (0.5 second) TKPOW2 (206).

When the result of step (206) is NO, after enrich (power increase) control conditions are established, the control means 60 receives a throttle opening signal from the throttle sensor 66 to return to the process of storing the previous throttle full opening time (202). When the result of step (206) is YES, the control means 60 determines whether or not a time during which the idle IDL is kept ON is greater than 0 and less than or equal to the third constant (1.0 second) TKPOW3 (208).

When the result of step (208) is NO, after enrich (power increase) control conditions are established, the control means 60 receives a throttle opening signal from the throttle sensor 66 to return to the process of storing the previous throttle full opening time (202). When the result of step (208) is YES, after the idle IDL is changed from ON to OFF, the control means 60 determines whether or not the FPOW (power increase) determining conditions are turned ON within the fourth constant (0.5 second) TKPOW4 (210).

When the result of step (210) is NO, after enrich (power increase) control conditions are established, the control means 60 receives a throttle opening signal from the throttle sensor 66 to return to the process of storing the previous throttle full opening time (202). When the result of step (2.10) is YES, the control means 60 recognizes that predetermined conditions are established and obtains a time TPOWON during which new FPOW (power increase) determining conditions are kept 0N by integrating a time TPOWONn during which the current FPOW (power increase) determining conditions are kept 0N with a time TPOWONn-1 during which the previous FPOW (power increase) determining conditions are kept 0N (212).

Thereafter, the control means 60 determines whether or not the time TPOWON during which this new FPOW (power increase) determining conditions are kept ON is greater than or equal to a predetermined time, e.g., 8 seconds (214). When the result of step (214) is NO, that is, the time TPOWON during which the new FPOW (power increase) determining conditions are kept ON, is less than 8 seconds, the time TPOWON during which the new FPOW (power increase) determining conditions are kept ON, is stored as the time TPOWONn-1 during which the previous FPOW (power increase) determining conditions are kept 0N (216). After the FPOW (power increase) determining conditions are changed from ON to OFF, the control means 60 proceeds to determine whether or not the idle IDL is turned ON within the second constant TKPOW2 (206).

When the result of step (214) is YES, the FPOW (power increase) determining conditions are changed from OFF to ON and the time TPOWON during which the FPOW (power increase) determining conditions are kept on, is reset to 0(218).

After resetting the time TPOWON during which the FPOW (power increase) determining conditions are kept 0N (218), the control means 60 determines whether or not the FPOW (power increase) determining conditions are changed from ON to OFF (220). When the result of step (220) is NO, step (220) is repeated until the result of step (220) is YES. When the result of step (220) is YES, the FPOW (power increase) determining conditions are changed from ON to OFF (222) and the control program is ended (224).

Thereby, an operating state when an up-shift operation is carried out during full-open acceleration is considered as continuous full-open accelerated driving so that enrich delay control can be carried out without fail, enrich control can be started after an elapse of a predetermined time with certainty, and control reliability can be improved.

In addition, the above advantages can be obtained simply by changing the program in the control means 60, whereby there is no possibility that the structure becomes complex and costs can be maintained at a low level, which is economically advantageous. Further, the predetermined conditions for identifying continuous full-open acceleration are specified in detail as the aforementioned four items, whereby the reliability of the operation of identifying continuous full-open acceleration is improved, which is practically advantageous.

According to the present invention as described above in detail, in the acceleration time controller for an internal combustion engine having control means for carrying out enrich delay control for starting enrich control for a power increase after an elapse of a predetermined time from the time when enrich control conditions are established at the time of accelerating the internal combustion engine, a throttle valve is provided along the intake passage of the internal combustion engine. A throttle sensor for detecting the throttle opening of the throttle valve is provided. Control means is provided with functions to (1) store the previous throttle full opening time upon reception of a throttle opening signal from this throttle sensor, (2) obtain a new throttle full opening time by integrating the current throttle full opening time under predetermined conditions for identifying continuous full-open acceleration, with the previous throttle full opening time, (3) store this new throttle full opening time as the previous throttle full opening time, when the new throttle full opening time is less than a predetermined time, and (4) start enrich delay control of the internal combustion engine when the new throttle full opening time is greater than or equal to the predetermined time. Therefore, an operation state when an up-shift operation is carried out during full-open acceleration is considered as continuous full-open accelerated driving so that enrich delay control can be carried out without fail, enrich control can be started after an elapse of a predetermined time with certainty, and control reliability can be improved. In addition, since the above advantages can be achieved simply by changing a program in the control means, there is no possibility that the structure becomes complex and costs can be maintained at a low level, which is economically advantageous.

What is claimed is:

1. An acceleration time controller for an internal combustion engine, comprising control means for carrying out an enrich delay control operation which starts an enrich control operation for a power increase after an elapse of a predetermined time from a time when enrich control conditions are established at the time of acceleration of the internal combustion engine, wherein a throttle valve is provided along an intake passage of the internal combustion engine, wherein a throttle sensor connected in circuit with the control means is provided for detecting a throttle opening of the throttle valve, and wherein the control means has means for storing a previous throttle full opening time upon reception of a throttle opening signal from the throttle sensor, wherein means is provided for obtaining a new throttle full opening time by integrating the current throttle full opening time with the previous throttle full opening time, wherein means is provided for storing the new throttle full opening time as the previous throttle full opening time when the new throttle full opening time is less than the predetermined time, and wherein means is provided for starting the enrich delay control operation of the internal combustion engine when the new throttle full opening time is greater than or equal to the predetermined time, the means for obtaining the new throttle opening time including means for determining whether the previous throttle full opening time is in a range greater than zero and less than a first time constant, means for determining whether the idle is turned on within a second time constant, means for determining whether an idle on-time is in a range greater than zero and less than a third time constant and means for determining whether the enrich control conditions are met within a fourth time constant.

2. The acceleration time controller according to claim 1, wherein the control means includes enrich control means for determining whether a power switch is turned on and whether a sum of intake manifold pressure and a valve pressure resulting from subtracting an atmospheric pressure from 750 being equal to or greater than a pressure constant.

3. A method of controlling an internal combustion engine having control means for carrying out an enrich delay control operation which starts an enrich control operation for a power increase after an elapse of a predetermined time from a time when enrich control conditions are established at a time of acceleration of the internal combustion engine, wherein a throttle valve is provided along an intake passage of the internal combustion engine, and a throttle sensor is provided for detecting a throttle opening of the throttle valve, comprising the steps of storing in the control means a previous throttle full opening time upon reception of a throttle opening signal from the throttle sensor, obtaining a new throttle full opening time by integrating a current throttle full opening time with the previous throttle full opening time, storing the new throttle full opening time as the previous throttle full opening time when the new throttle full opening time is less than the predetermined time, and starting the enrich delay control operation of the internal combustion engine when the new throttle full opening time is greater than or equal to the predetermined time, and the step of obtaining the new throttle full opening time including the steps of determining whether the previous throttle opening time is in a range greater than zero and less than a first time constant, determining whether the idle is turned on within a second time constant, determining whether an idle on-time is in a range greater than zero and less than a third time constant, and determining whether the enrich control conditions are met within a fourth time constant.

4. The method according to claim 3, further comprising the steps of determining whether the a power switch is turned on and determining whether a sum of intake manifold pressure and a valve pressure resulting from subtacting an atmospheric pressure from 750 being equal to or greater than a pressure constant.

* * * * *